US011527816B2

(12) United States Patent
Sudo et al.

(10) Patent No.: US 11,527,816 B2
(45) Date of Patent: Dec. 13, 2022

(54) ANTENNA ELEMENT, ANTENNA MODULE, AND COMMUNICATION DEVICE

(71) Applicant: Murata Manufacturing Co., Ltd., Kyoto (JP)

(72) Inventors: Kaoru Sudo, Kyoto (JP); Hirotsugu Mori, Kyoto (JP); Kengo Onaka, Kyoto (JP); Tadashi Sugahara, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 92 days.

(21) Appl. No.: 17/155,300

(22) Filed: Jan. 22, 2021

(65) Prior Publication Data

US 2021/0143531 A1 May 13, 2021

Related U.S. Application Data

(63) Continuation of application No. PCT/JP2019/029676, filed on Jul. 29, 2019.

(30) Foreign Application Priority Data

Aug. 9, 2018 (JP) ..... JP2018-150511

(51) Int. Cl.
*H01Q 1/22* (2006.01)
*H01Q 1/24* (2006.01)
(Continued)

(52) U.S. Cl.
CPC ..... *H01Q 1/248* (2013.01); *H01Q 1/2283* (2013.01); *H01Q 1/48* (2013.01); *H01Q 13/08* (2013.01); *H01Q 23/00* (2013.01)

(58) Field of Classification Search
CPC ..... H01Q 1/2283; H01Q 1/48; H01Q 23/00
See application file for complete search history.

(56) References Cited

U.S. PATENT DOCUMENTS

2005/0017902 A1* 1/2005 Oyama ..... H05K 1/142 343/700 MS
2007/0273588 A1 11/2007 Kim et al.
(Continued)

FOREIGN PATENT DOCUMENTS

JP 2003-332830 A 11/2003
JP 2007-013327 A 1/2007
(Continued)

OTHER PUBLICATIONS

International Search Report for PCT/JP2019/029676 dated Aug. 27, 2019.
Written Opinion for PCT/JP2019/029676 dated Aug. 27, 2019.

*Primary Examiner* — Daniel Munoz
(74) *Attorney, Agent, or Firm* — Pearne & Gordon LLP

(57) ABSTRACT

An antenna element includes a dielectric substrate, a radiation electrode, a first ground electrode, a second ground electrode, and a via conductor that connects the first ground electrode and the second ground electrode to each other. The dielectric substrate includes a flat-plate-shaped first part and a second part that is thinner than the first part. The radiation electrode and the first ground electrode are arranged on or in the first part so as to face each other in the thickness direction of the first part. The second ground electrode is spaced apart from the radiation electrode. The second ground electrode is arranged on or in the second part so as to not face the radiation electrode in the thickness direction of the second part. The radiation electrode is capacitively coupled to the second ground electrode and the via conductor.

21 Claims, 13 Drawing Sheets

(51) Int. Cl.

| | |
|---|---|
| ***H01Q 13/08*** | (2006.01) |
| ***H01Q 23/00*** | (2006.01) |
| ***H01Q 1/48*** | (2006.01) |

(56) References Cited

U.S. PATENT DOCUMENTS

| | | | | |
|---|---|---|---|---|
| 2012/0105302 | A1* | 5/2012 | Kato | H01Q 13/08<br>343/905 |
| 2014/0306846 | A1 | 10/2014 | Nakatsu et al. | |
| 2017/0222316 | A1 | 8/2017 | Mizunuma et al. | |
| 2017/0279177 | A1 | 9/2017 | Oguri et al. | |
| 2018/0205145 | A1 | 7/2018 | Hamabe | |
| 2019/0207323 | A1* | 7/2019 | Joung | H01Q 1/243 |

FOREIGN PATENT DOCUMENTS

| | | | |
|---|---|---|---|
| JP | 2008-061030 | A | 3/2008 |
| JP | 2014-212361 | A | 11/2014 |
| WO | 2016/063759 | A1 | 4/2016 |
| WO | 2017/051526 | A1 | 3/2017 |
| WO | 2017/051649 | A1 | 3/2017 |

* cited by examiner

ANTENNA ELEMENT, ANTENNA MODULE, AND COMMUNICATION DEVICE

CROSS REFERENCE TO RELATED APPLICATIONS

This is a continuation of International Application No. PCT/JP2019/029676 filed on Jul. 29, 2019 which claims priority from Japanese Patent Application No. 2018-150511 filed on Aug. 9, 2018. The contents of these applications are incorporated herein by reference in their entireties.

BACKGROUND OF THE DISCLOSURE

Field of the Disclosure

The present disclosure relates to an antenna element in which a radiation electrode and a ground electrode are arranged so as to face each other, an antenna module that includes the antenna element, and a communication device that includes the antenna module.

Description of the Related Art

Heretofore, an antenna element is known in which a radiation electrode and a ground electrode are arranged so as to face each other. For example, International Publication No. 2016/063759 (Patent Document 1) discloses a wireless communication module in which an antenna pattern and a ground layer are arranged in a dielectric substrate so as to face each other. According to the wireless communication module, unwanted radiation from radio-frequency elements can be blocked by the ground layer and ground conductor pillars inside the dielectric substrate.

Patent Document 1: International Publication No. 2016/063759

BRIEF SUMMARY OF THE DISCLOSURE

It is known that the radiation characteristics of an antenna element are improved by increasing the area of a ground electrode that is capacitively coupled to a radiation electrode. However, depending on the space in which the antenna element is arranged, the shape and arrangement of the ground electrode, which faces the radiation electrode, may be limited and it may not be possible to increase the area of the ground electrode, which is capacitively coupled to the radiation electrode. In such a case, it may be difficult to improve the radiation characteristics of the antenna element by widening the ground electrode, which faces the radiation electrode.

The present disclosure is made in order to solve the above-described problem, and it is an object thereof to improve the radiation characteristics of an antenna element in which a radiation electrode and a ground electrode are arranged so as to face each other.

An antenna element according to an embodiment of the present disclosure includes a dielectric substrate, a radiation electrode, a first ground electrode, a second ground electrode, and a via conductor. The dielectric substrate includes a first part and a second part. The first part is shaped like a flat plate. The second part is thinner than the first part. The radiation electrode and the first ground electrode are arranged on or in the first part so as to face each other in the thickness direction of the first part. The second ground electrode is spaced apart from the radiation electrode. The second ground electrode is arranged on or in the second part so as to not face the radiation electrode in a thickness direction of the second part. The via conductor connects the first ground electrode and the second ground electrode to each other. The radiation electrode is capacitively coupled to the second ground electrode and the via conductor.

According to the antenna element of the embodiment of the present disclosure, the radiation characteristics can be improved due to the radiation electrode, which faces the first ground electrode, capacitively coupling to both the second ground electrode and the via conductor.

DETAILED DESCRIPTION OF THE DISCLOSURE

Figure 1:
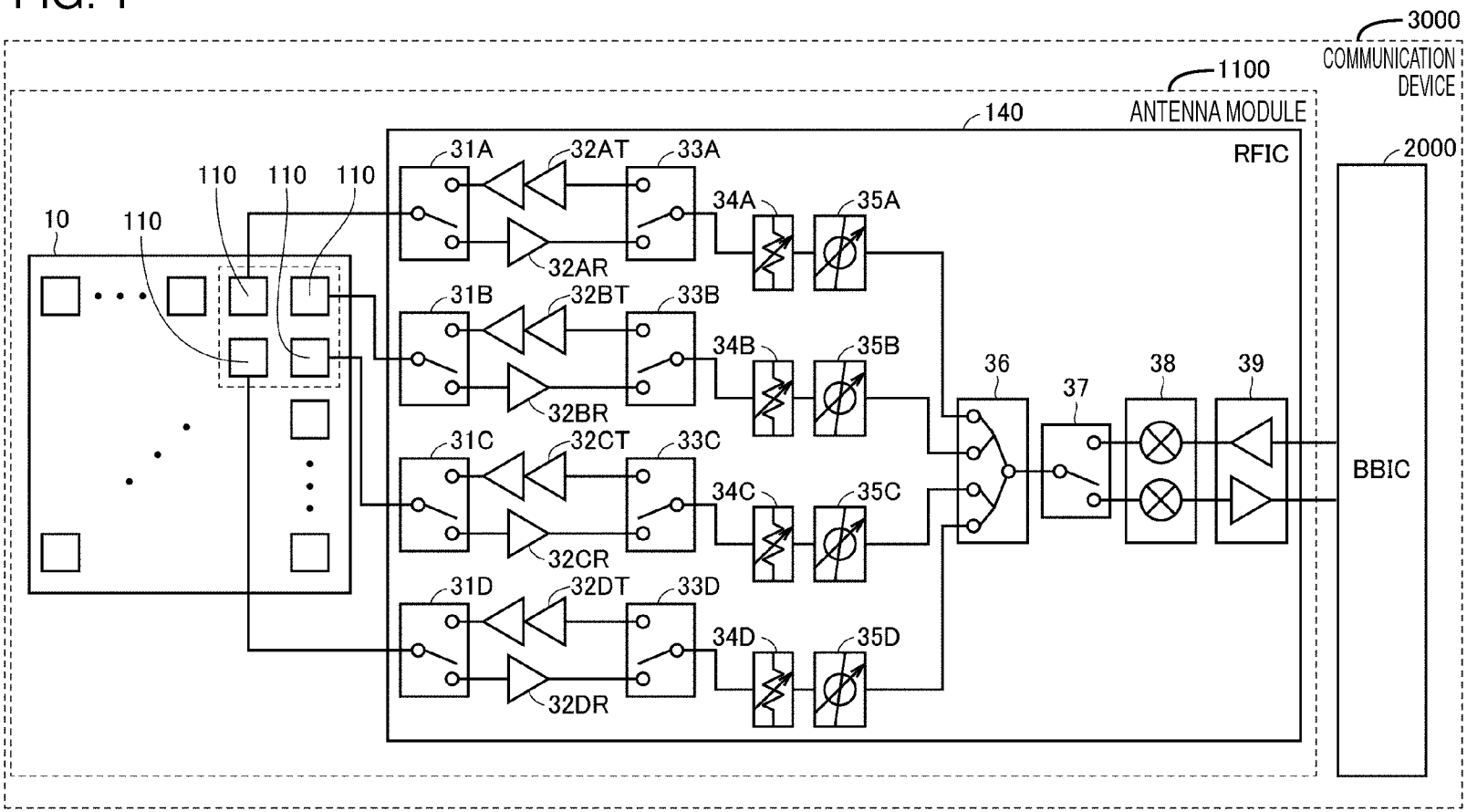
FIG. 1 is a block diagram of a communication device that includes an antenna element.

Hereafter, embodiments will be described in detail while referring to the drawings. Generally, identical or corresponding parts in the figures are denoted by the same symbols and the description thereof is not repeated.

FIG. 1 is a block diagram of a communication device 3000 that includes an antenna element 10. The communication device 3000 may be a mobile terminal such as a cellular phone, a smartphone, or a tablet or may be a personal computer having a communication function.

As illustrated in FIG. 1, the communication device 3000 includes an antenna module 1100 and a baseband integrated circuit (BBIC) 2000 that forms a baseband signal processing circuit. The antenna module 1100 includes a radio-frequency integrated circuit (RFIC) 140, which is an example of a radio-frequency element, and the antenna element 10.

The communication device 3000 up converts a baseband signal, which has been transmitted from the BBIC 2000 to the antenna module 1100, into a radio-frequency signal and radiates the radio-frequency signal from the antenna element 10. The communication device 3000 down converts a radio-frequency signal received by the antenna element 10 into a baseband signal and performs signal processing on the baseband signal in the BBIC 2000.

The antenna element 10 is an antenna array in which a plurality of flat-plate-shaped antenna elements (radiation conductors) are regularly arranged. In FIG. 1, the configuration of the part of the RFIC 140 corresponding to four radiation electrodes 110, which are surrounded by a dotted line, out of a plurality of radiation electrodes 110 included in the antenna element 10 is illustrated.

The RFIC 140 includes switches 31A to 31D, 33A to 33D, and 37, power amplifiers 32AT to 32DT, low-noise amplifiers 32AR to 32DR, attenuators 34A to 34D, phase shifters 35A to 35D, a signal multiplexer/demultiplexer 36, a mixer 38, and an amplification circuit 39.

The RFIC 140, for example, is formed as a one chip integrated circuit component that includes circuit elements (switches, power amplifiers, low-noise amplifiers, attenuators, and phase shifters) corresponding to the plurality of radiation electrodes 110 included in the antenna element 10. Alternatively, the circuit elements may be formed as a one chip integrated circuit component for each radiation electrode 110 separately from the RFIC 140.

In the case where a radio-frequency signal is to be received, the switches 31A to 31D and 33A to 33D are switched to the low-noise amplifiers 32AR to 32DR, and the switch 37 is connected to a reception-side amplifier of the amplification circuit 39.

Radio-frequency signals received by the radiation electrodes 110 pass along signal paths from the switches 31A to 31D to the phase shifters 35A to 35D, are multiplexed by the signal multiplexer/demultiplexer 36, and the resulting signal is down-converted by the mixer 38, amplified by the amplification circuit 39, and transmitted to the BBIC 2000.

In the case where a radio-frequency signal is to be transmitted from the antenna element 10, the switches 31A to 31D and 33A to 33D are switched to the power amplifiers 32AT to 32DT, and the switch 37 is connected to a transmission-side amplifier of the amplification circuit 39.

A baseband signal transmitted from the BBIC 2000 is amplified by the amplification circuit 39 and up-converted by the mixer 38. The up-converted radio-frequency signal is divided into four signals by the signal multiplexer/demultiplexer 36, and the resulting signals pass along the signal paths from the phase shifters 35A to 35D to the switches 31A to 31D and are supplied to the radiation electrodes 110. The directivity of the antenna element 10 can be adjusted by individually adjusting the phases of the phase shifters 35A to 35D arranged on the respective signal paths.

The radiation characteristics of the antenna element 10 are affected by the size of the area of a ground electrode that is capacitively coupled to the radiation electrodes 110. Hereafter, the relationship between the radiation characteristics of the antenna array and the size of the area of the ground electrode that is capacitively coupled to the radiation electrodes 110 will be described using an antenna element according to a reference example of embodiment 1.

Figure 2:
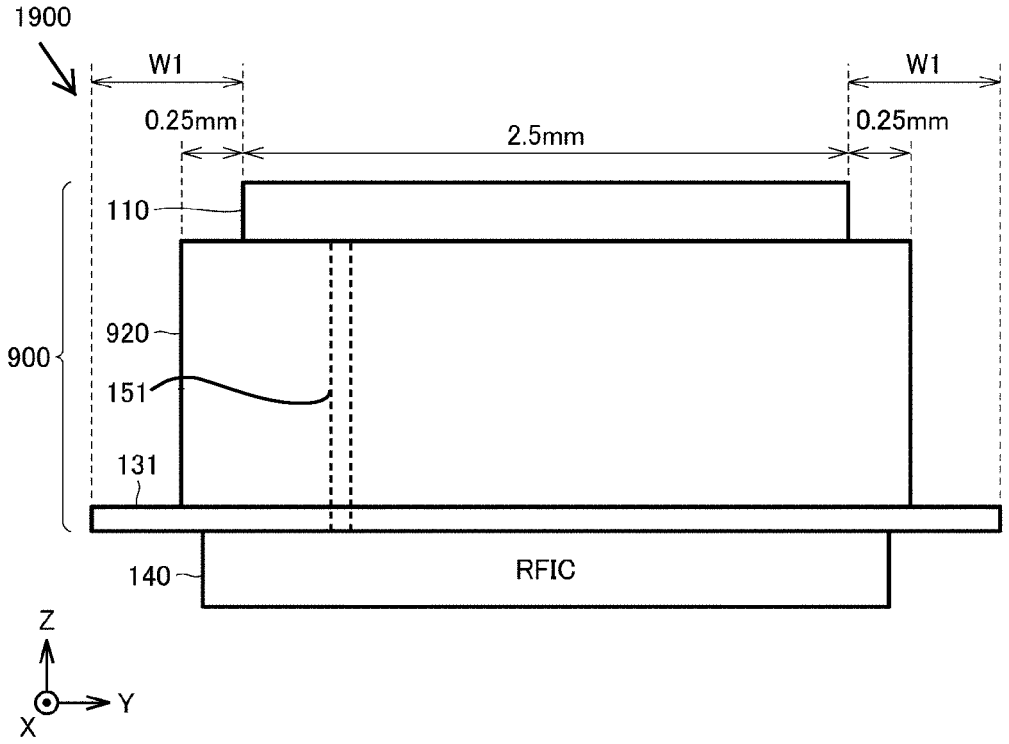
FIG. 2 is a plan view of an antenna module including an antenna element according to a reference example of embodiment 1 from an X-axis direction.

FIG. 2 is a plan view of an antenna module 1900 including an antenna element 900 according to the reference example of embodiment 1 from an X-axis direction. In FIG. 2, the X axis, the Y axis, and the Z axis are perpendicular to one another. The same applies to FIGS. 4 and 6 to 14.

As illustrated in FIG. 2, the antenna module 1900 includes the antenna element 900 and an RFIC 140. The antenna element 900 includes a radiation electrode 110, a ground electrode 131 (first ground electrode), a via conductor 151, and a dielectric substrate 920. A normal direction of the radiation electrode 110 is a Z-axis direction. The radiation electrode 110 and the ground electrode 131 are arranged on the dielectric substrate 920 so as to face each other in a thickness direction (Z-axis direction) of the dielectric substrate 920. The radiation electrode 110 is capacitively coupled to the ground electrode 131.

The via conductor 151 penetrates through the ground electrode 131 and connects the radiation electrode 110 to the RFIC 140. The via conductor 151 is insulated from the ground electrode 131.

The RFIC 140 supplies a radio-frequency signal to the radiation electrode 110 through the via conductor 151. The RFIC 140 receives a radio-frequency signal from the radiation electrode 110 through the via conductor 151.

The width of the radiation electrode 110 in the Y-axis direction is 2.5 mm. The spacing between the dielectric substrate 920 and both ends of the radiation electrode 110 in the Y-axis direction is 0.25 mm. The spacing between the ground electrode 131 and both ends of the radiation electrode 110 in the Y-axis direction is W1. The width of the ground electrode 131 in the Y-axis direction is $2 \cdot W1+2.5$ (mm).

Figure 3:
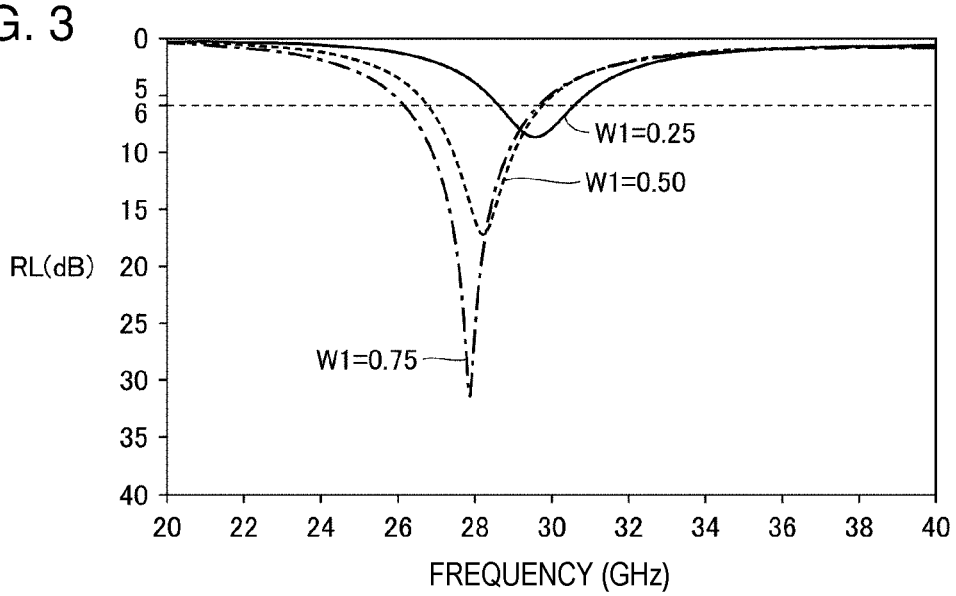
FIG. 3 is a diagram illustrating simulation results of the reflection characteristic of an antenna element when the Y-axis direction width of a ground electrode illustrated in FIG. 2 is varied.

FIG. 3 is a diagram illustrating simulation results of a reflection characteristic (relationship between frequency and return loss (RL)) of the antenna element 900 when the Y-axis direction width of the ground electrode 131 illustrated in FIG. 2 is varied. In FIG. 3, the reflection characteristic is illustrated for the cases where the spacing W1 is 0.25 mm, 0.50 mm, and 0.75 mm.

This means that the portion of a radio-frequency signal radiated to the outside from the radiation electrode 110 out of a radio-frequency signal supplied to the radiation electrode 110 from the RFIC 140 increases as the return loss increases. Therefore, the width of the bandwidth over which a return loss greater than or equal to a threshold is achieved is one criteria used to evaluate the radiation characteristics of the antenna element 900. In other words, it may be said that the radiation characteristics of the antenna element 900 are improved as this band width increases.

Accordingly, in FIG. 3, the radiation characteristics of the antenna element 900 are compared while focusing on the widths of the bandwidth where the return loss is greater than or equal to 6 dB. The same also applies to FIG. 5.

As illustrated in FIG. 3, the larger the spacing W1, the larger the area of ground electrode 131 that capacitively couples to the radiation electrode 110, and therefore the wider the bandwidth over which the return loss is greater than or equal to 6 dB. In other words, the radiation characteristics of the antenna element 900 are improved by increasing the area of the ground electrode 131 that is capacitively coupled to the radiation electrode 110.

However, depending on the space in which the antenna element 900 is arranged, the shape and arrangement of the ground electrode 131, which faces the radiation electrode 110, may be limited and it may not be possible to increase the area of the ground electrode 131, which is capacitively coupled to the radiation electrode 110. An antenna element according to embodiment 1 can improve the radiation characteristics even when arranged in such a space. Hereafter, an antenna element according to embodiment 1 will be described in detail.

Embodiment 1

Figure 4:
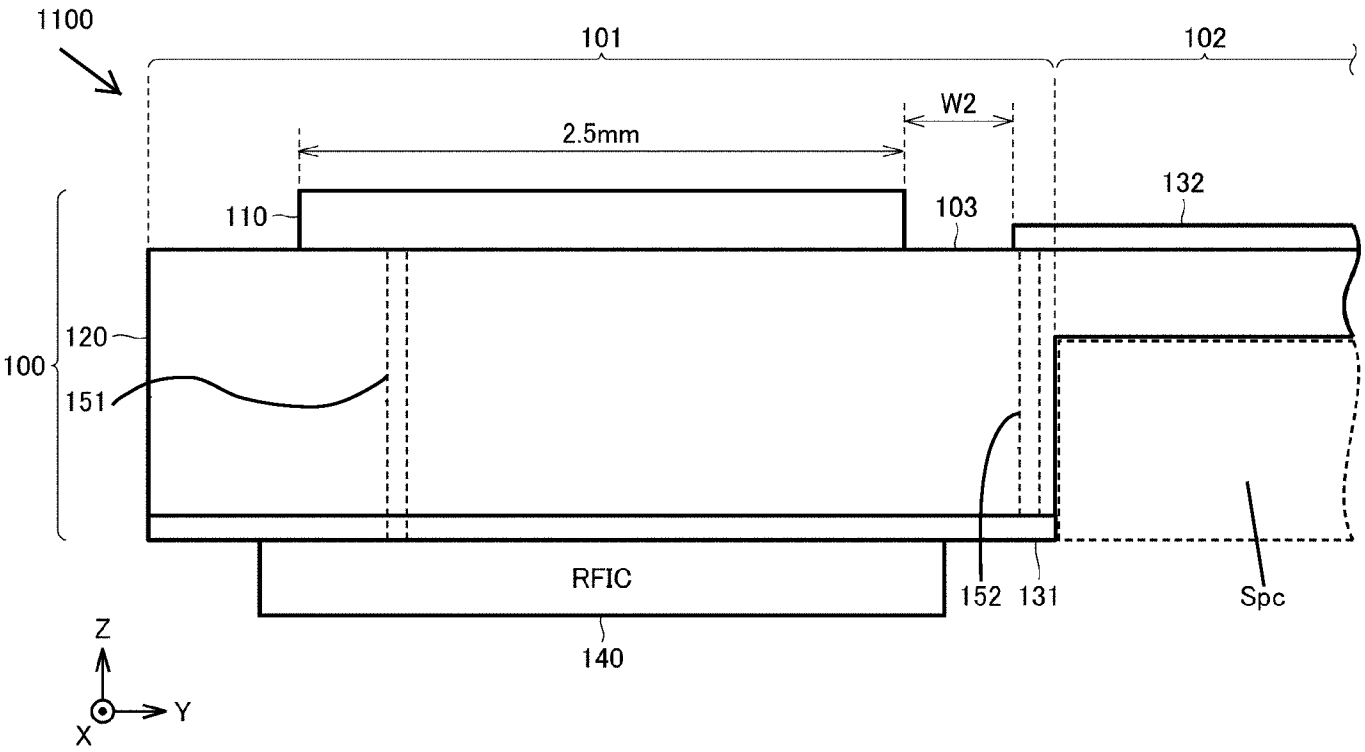
FIG. 4 is a plan view of an antenna module including an antenna element according to embodiment 1 from an X-axis direction.

FIG. 4 is a plan view of an antenna module 1100 including an antenna element 100 according to embodiment 1 from an X-axis direction. The antenna module 1100 has a configuration obtained by replacing the antenna element 900 of the antenna module 1900 in FIG. 2 with the antenna element 100. The antenna element 100 in FIG. 4 has a configuration obtained by replacing the dielectric substrate 920 of the antenna element 900 in FIG. 2 with a dielectric substrate 120 and adding a ground electrode 132 (second ground electrode) and a via conductor 152. The rest of the configuration is identical and therefore the description thereof will not be repeated.

As illustrated in FIG. 4, the dielectric substrate 120 includes a flat-plate-shaped part 101 (first part) and a part 102 (second part). The part 102 is thinner than the part 101 in the Z-axis direction. The dielectric substrate 120 is formed from a single piece of dielectric material. In other words, the dielectric substrate 120 is a substrate integrally molded from a dielectric material having a certain dielectric constant.

The radiation electrode 110 and the ground electrode 132 are arranged so as to be spaced apart from each other on a specific surface 103 of the dielectric substrate 120. The via conductor 152 extends in the Z-axis direction and connects the ground electrodes 131 and 132 to each other. The radiation electrode 110 is capacitively coupled to the ground electrode 132 and the via conductor 152. A spacing W2 is the spacing between the radiation electrode 110 and the ground electrode 132 in the Y axis direction. Note that the radiation electrode 110 and the ground electrode 132 may instead be arranged inside the dielectric substrate 120.

A space Spc is formed on the side of the part 102 where the ground electrode 132 is not arranged. Other circuit elements are arranged in the space Spc. Therefore, the width of the ground electrode 131 in the Y-axis direction cannot be extended into the space Spc. In the antenna element 100, the radiation characteristics of the antenna element 100 cannot be improved by extending the ground electrode 131 into the space Spc.

Accordingly, in embodiment 1, the ground electrode 132 is arranged in the part 102, and the ground electrodes 131 and 132 are connected to each other by the via conductor 152. The radiation characteristics of the antenna element 100 can be improved by the radiation electrode 110 being capacitively coupled to the ground electrode 132 and the via conductor 152 in addition to the ground electrode 131.

Figure 5:
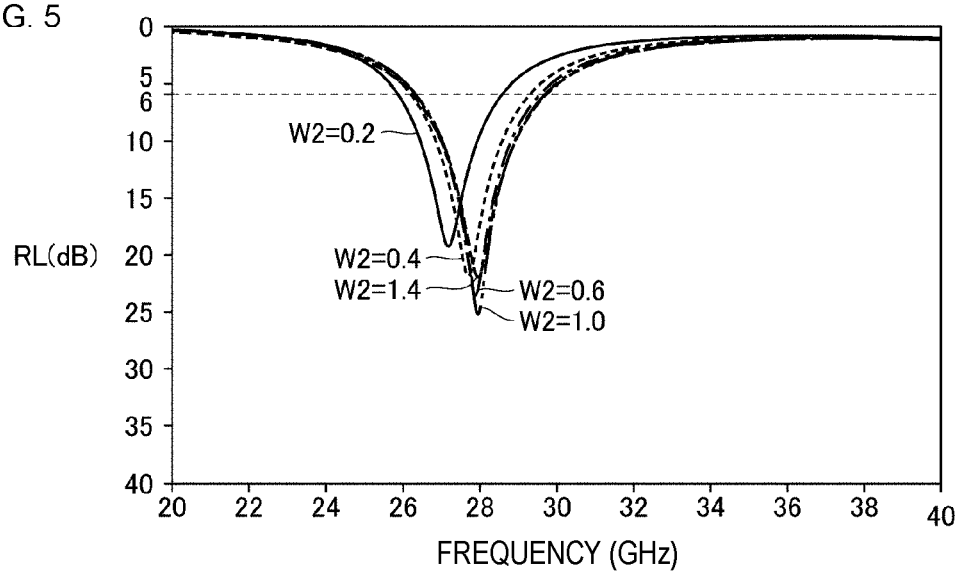
FIG. 5 is a diagram illustrating simulation results of the reflection characteristic of an antenna element when the Y-axis direction spacing between a radiation electrode and a ground electrode illustrated in FIG. 4 is varied.

FIG. 5 is a diagram illustrating simulation results of the reflection characteristic of the antenna element 100 when the Y-axis direction spacing W2 between the radiation electrode 110 and the ground electrode 132 illustrated in FIG. 4 is varied. In FIG. 5, the reflection characteristic is illustrated for the cases where the spacing W2 is 0.2 mm, 0.4 mm, and 0.6 mm.

As illustrated in FIG. 5, the bandwidth where the return loss is greater than or equal to 6 dB sequentially increases as the spacing W2 is increased as 0.2 mm, 0.4 mm, 0.6 mm, 1.0 mm, and 1.4 mm. The radiation characteristics of the antenna element 100 can be further improved by adjusting the spacing W2 between the radiation electrode 110 and the ground electrode 132 to a suitable distance.

Modification 1 of Embodiment 1

In embodiment 1, a case in which a radiation electrode and a second ground electrode are arranged on a specific surface of a dielectric substrate is described. The radiation electrode and the second ground electrode may instead be arranged on different surfaces.

Figure 6:
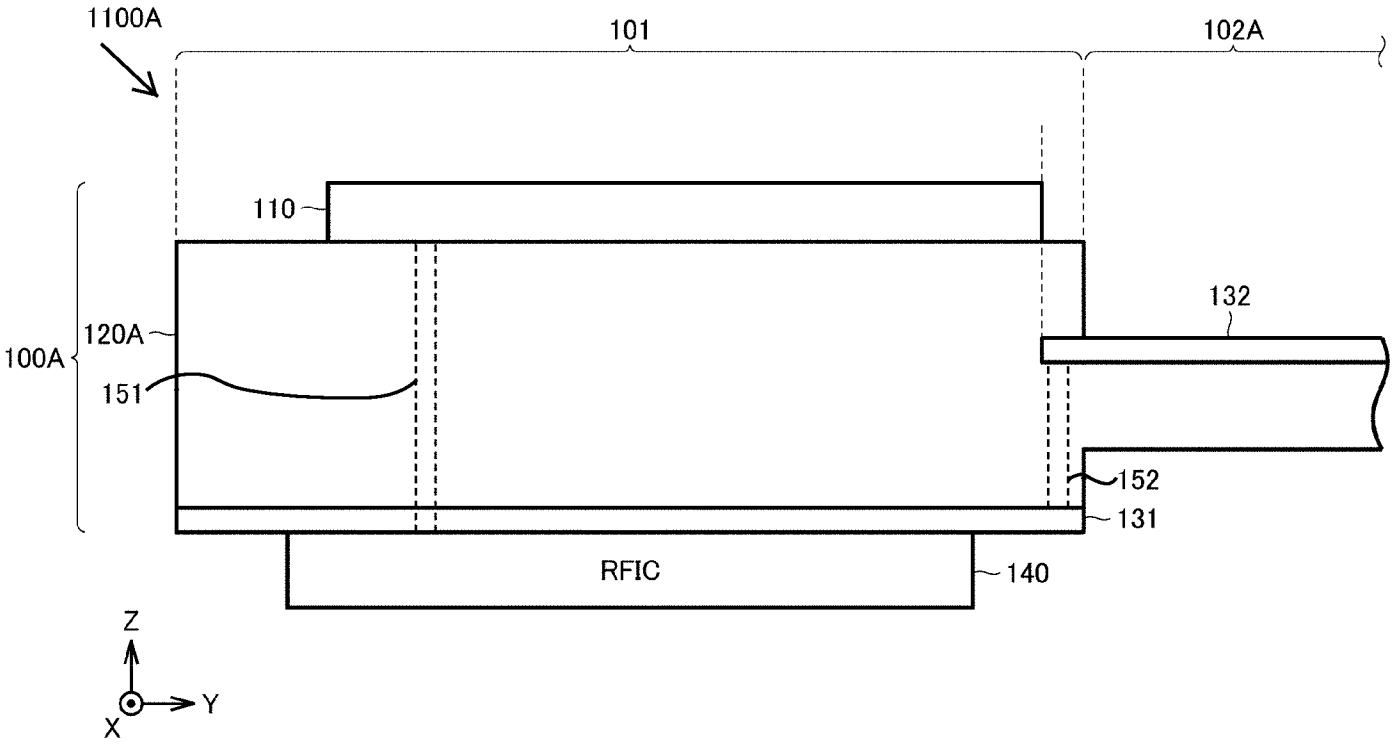
FIG. 6 is a plan view of an antenna module including an antenna element according to modification 1 of embodiment 1 from an X-axis direction.

FIG. 6 is a plan view of an antenna module 1100A including an antenna element 100A according to modification 1 of embodiment 1 from an X-axis direction. The antenna module 1100A has a configuration obtained by replacing the antenna element 100 in FIG. 4 with the antenna element 100A. The antenna element 100A in FIG. 6 has a configuration obtained by replacing the dielectric substrate 120 in FIG. 4 with a dielectric substrate 120A. The dielectric substrate 120A in FIG. 6 has a configuration obtained by replacing the part 102 in FIG. 4 with a part 102A. The rest of the configuration is identical and therefore the description thereof will not be repeated.

As illustrated in FIG. 6, the parts 101 and 102A are arranged so as to be shifted from each other in the Z-axis direction and form a step. The ground electrode 132 is spaced apart from the radiation electrode 110 in the Z-axis direction. Therefore, the ground electrode 132 does not have to be spaced apart from the radiation electrode 110 in the Y-axis direction.

Modification 2 of Embodiment 1

A case in which the dielectric substrate is formed from a single piece of dielectric material is described in embodiment 1 and modification 1. The dielectric substrate may instead be formed of a plurality of dielectric layers.

Figure 7:
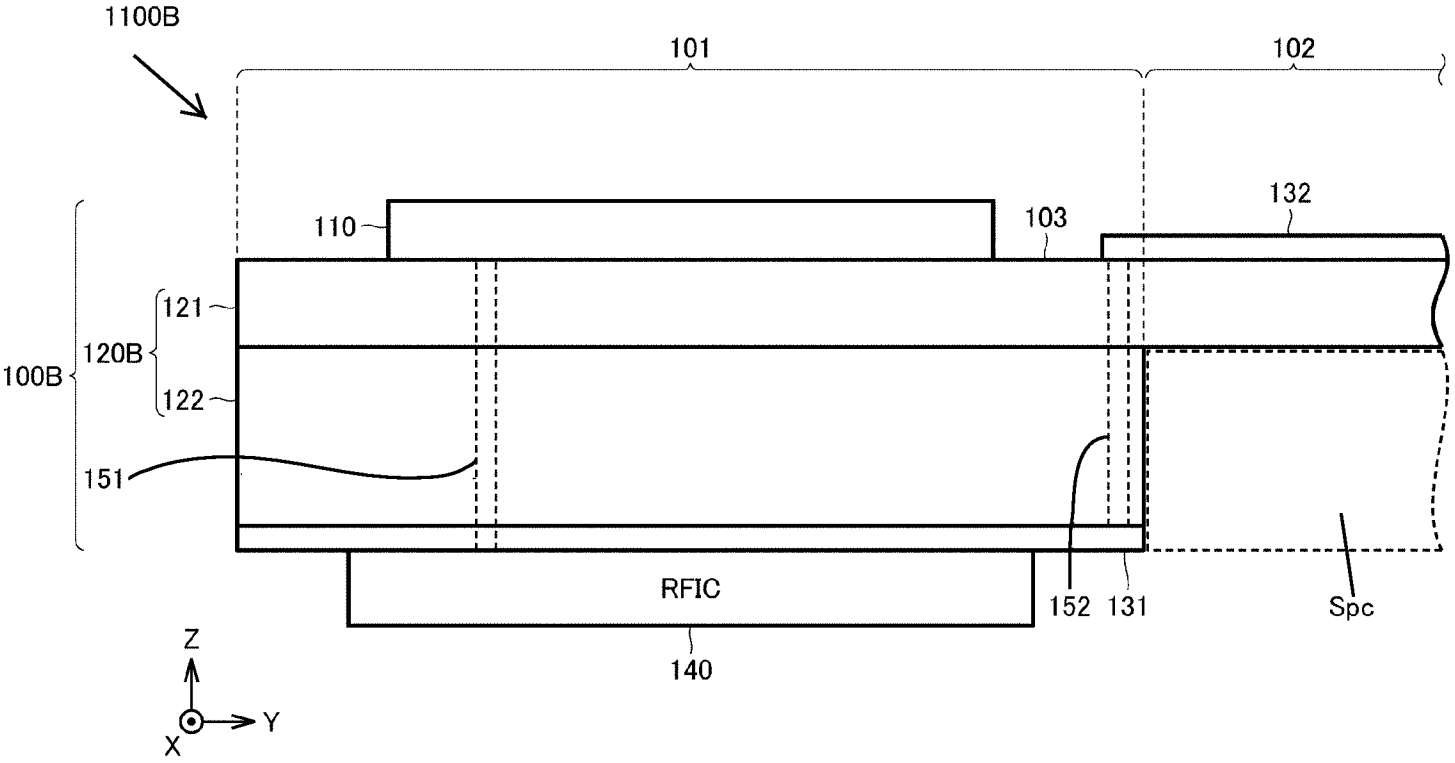
FIG. 7 is a plan view of an antenna module including an antenna element according to modification 2 of embodiment 1 from an X-axis direction.

FIG. 7 is a plan view of an antenna module 1100B including an antenna element 100B according to modification 2 of embodiment 1 from an X-axis direction. The antenna module 1100B has a configuration obtained by replacing the antenna element 100 in FIG. 4 with the antenna element 100B. The antenna element 100B in FIG. 7 has a configuration obtained by replacing the dielectric substrate 120 in FIG. 4 with a dielectric substrate 120B. The rest of the configuration is identical and therefore the description thereof will not be repeated.

As illustrated in FIG. 7, the dielectric substrate 120B includes a dielectric layer 121 (first dielectric layer) and a dielectric layer 122 (second dielectric layer). The dielectric layer 121 is a first substrate molded from a dielectric material having a first dielectric constant. The dielectric layer 122 is a second substrate molded from a dielectric material having a second dielectric constant. The dielectric substrate 120 is a substrate in which the dielectric layers 121 and 122 are integrated with each other by welding using heat or adhesion using connecting members (for example, solder bumps). The first dielectric constant and the second dielectric constant may be different from each other.

The dielectric layer 121 is formed so as to span across the parts 101 and 102. The dielectric layer 121 includes a specific surface 103. The dielectric layer 122 is formed in the part 101. The ground electrode 131 is arranged on the dielectric layer 122. The radiation electrode 110 and the ground electrode 132 may instead be arranged inside the dielectric layer 121.

Modifications 3 and 4 of Embodiment 1

A case in which the radiation electrode of the antenna element is formed of one electrode has been described in embodiment 1 and modifications 1 and 2. In modifications 3 and 4 of embodiment 1, a case will be described in which the radiation electrode of the antenna element has a stacked structure formed of a power-fed element and a non-power-fed element.

Figure 8:
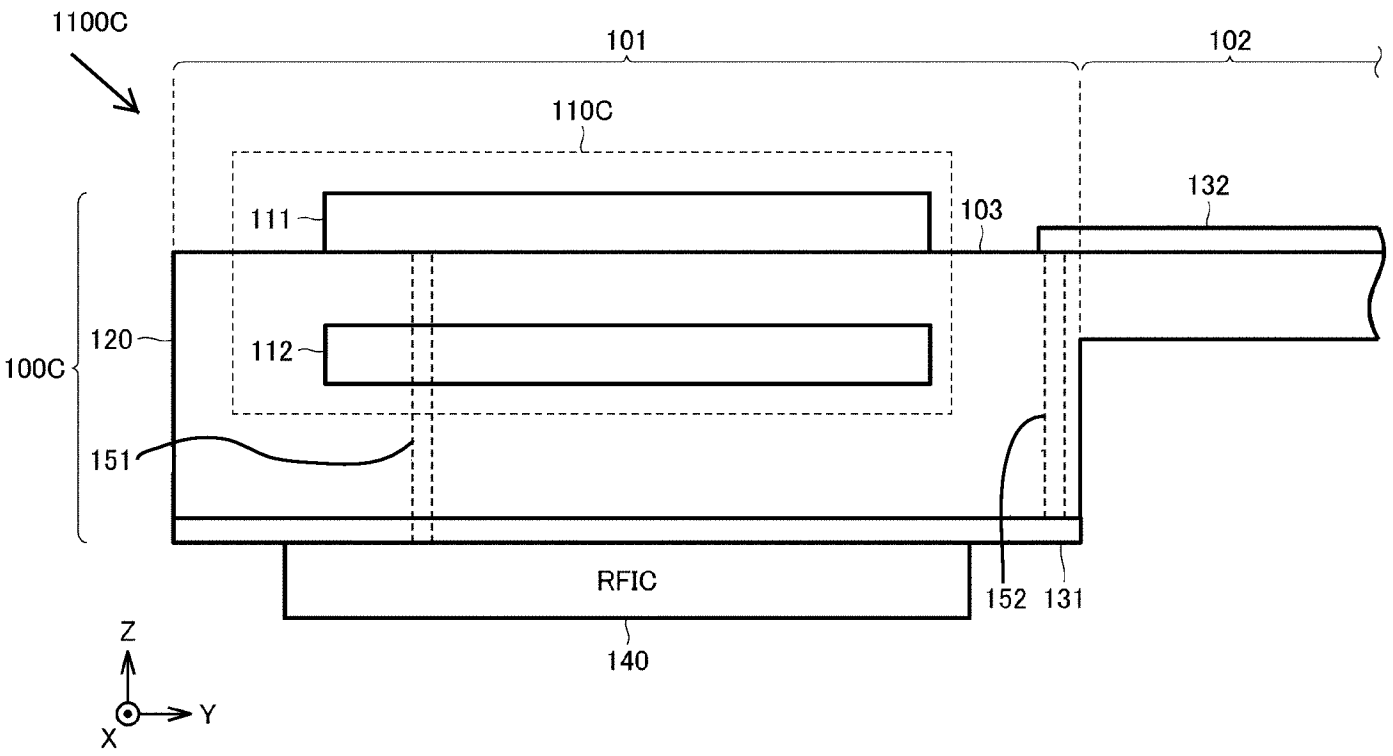
FIG. 8 is a plan view of an antenna module including an antenna element according to modification 3 of embodiment 1 from an X-axis direction.

FIG. 8 is a plan view of an antenna module 1100C including an antenna element 100C according to modification 3 of embodiment 1 from an X-axis direction. The antenna module 1100C has a configuration obtained by replacing the antenna element 100 in FIG. 4 with the antenna element 100C. The antenna element 100C in FIG. 8 has a configuration obtained by replacing the radiation electrode 110 in FIG. 4 with a radiation electrode 110C. The rest of the configuration is identical and therefore the description thereof will not be repeated.

As illustrated in FIG. 8, the radiation electrode 110C includes a power-fed element 111 and a non-power-fed element 112. The power-fed element 111 is arranged on the specific surface 103. The power-fed element 111 may instead be arranged inside the dielectric substrate 120. The power-fed element 111 is capacitively coupled to the ground electrode 132 and the via conductor 152.

The non-power-fed element 112 is arranged between the ground electrode 131 and the power-fed element 111 in the extension direction of the via conductor 152 (Z-axis direction). The via conductor 151 penetrates through the non-power-fed element 112 and connects the power-fed element 111 to the RFIC 140.

The radiation characteristics can be improved by the antenna element 100C as well due to the power-fed element 111 capacitively coupling to the ground electrode 132 and the via conductor 152 in addition to the ground electrode 131. Furthermore, the radiation characteristics can be improved for the non-power-fed element 112 as well due to the same effect as for the power-fed element 111.

Figure 9:
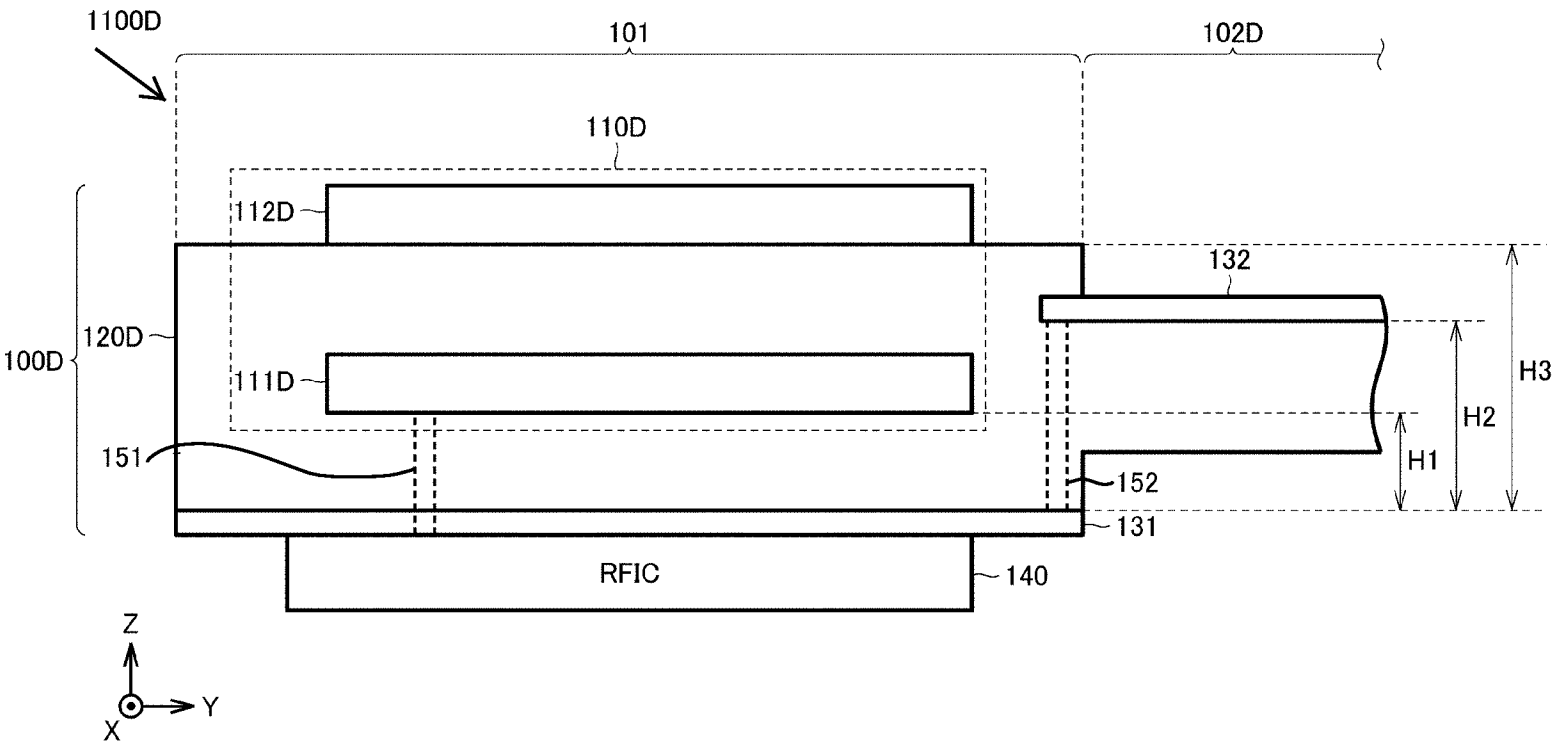
FIG. 9 is a plan view of an antenna module including an antenna element according to modification 4 of embodiment 1 from an X-axis direction.

FIG. 9 is a plan view of an antenna module 1100D including an antenna element 100D according to modification 4 of embodiment 1 from an X-axis direction. The antenna module 1100D has a configuration obtained by replacing the antenna element 100 in FIG. 4 with the antenna element 100D. The antenna element 100D in FIG. 9 has a configuration obtained by replacing the radiation electrode 110 and the dielectric substrate 120 in FIG. 4 with a radiation electrode 110D and a dielectric substrate 120D. The dielectric substrate 120D in FIG. 10 has a configuration obtained by replacing the part 102 in FIG. 4 with a part 102D. The rest of the configuration is identical and therefore the description thereof will not be repeated.

As illustrated in FIG. 9, the radiation electrode 110D includes a power-fed element 111D and a non-power-fed element 112D. The power-fed element 111D is arranged between the ground electrode 131 and the non-power-fed element 112D in the Z-axis direction. The via conductor 151 connects the power-fed element 111D to the RFIC 140.

A distance H1 is the distance between the power-fed element 111D and the ground electrode 131 in the Z-axis direction. A distance H2 is the distance between the ground electrodes 132 and 131 in the Z-axis direction. A distance H3 is the distance between the non-power-fed element 112D and the ground electrode 131 in the Z-axis direction.

The distance H2 is longer than the distance H1 and shorter than the distance H3. The directivity of the power-fed element 111D and the non-power-fed element 112D can be adjusted by setting the relationship between the sizes of the distances H1 to H3 in this way.

According to the antenna elements of embodiment 1 and modifications 1 to 4, the radiation characteristics can be improved.

Embodiment 2

In embodiment 2, a case will be described in which a dielectric substrate of an antenna element is bent.

Figure 10:
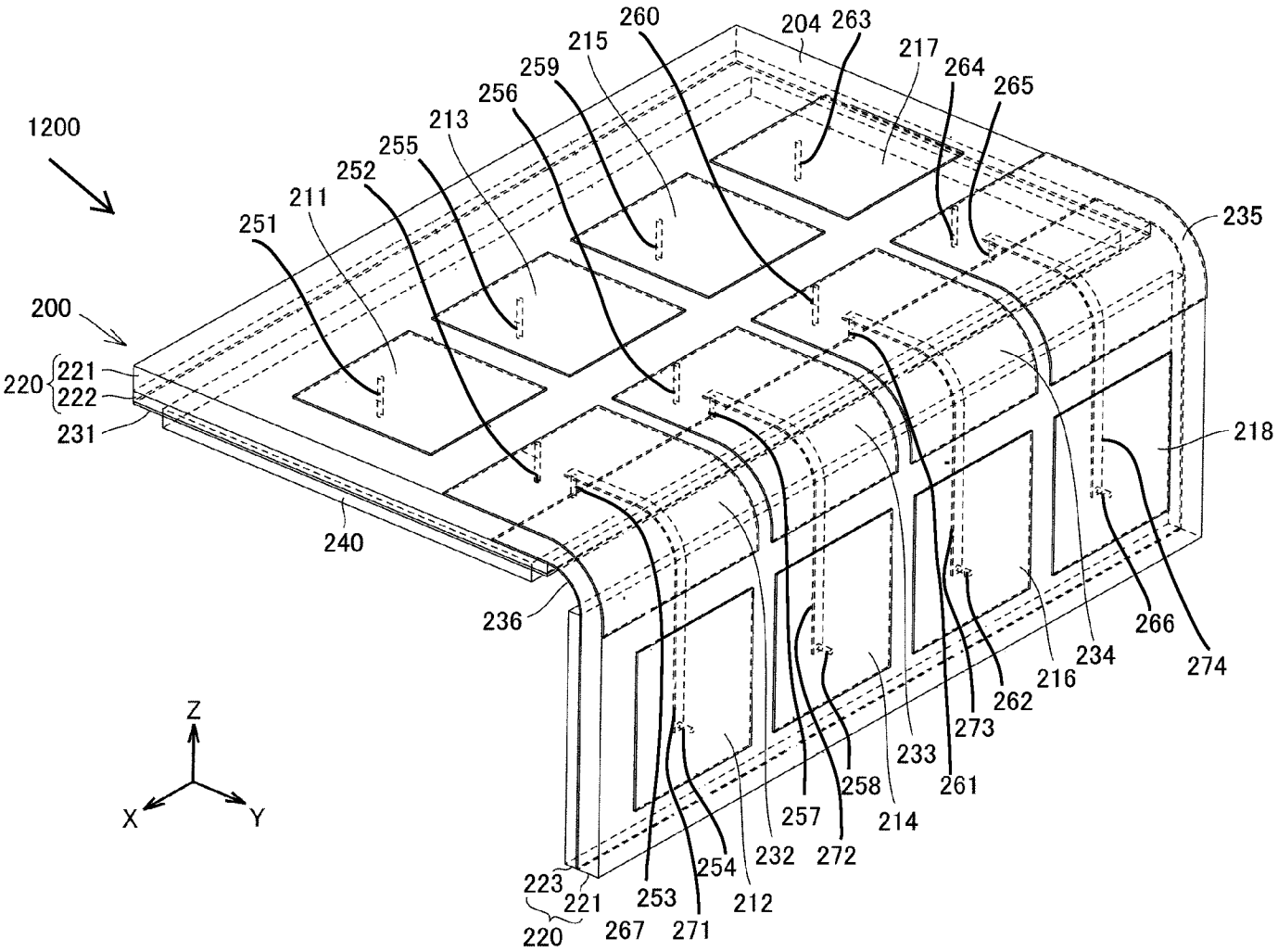
FIG. 10 is an external perspective view of an antenna module including an antenna element according to embodiment 2.
Figure 11:
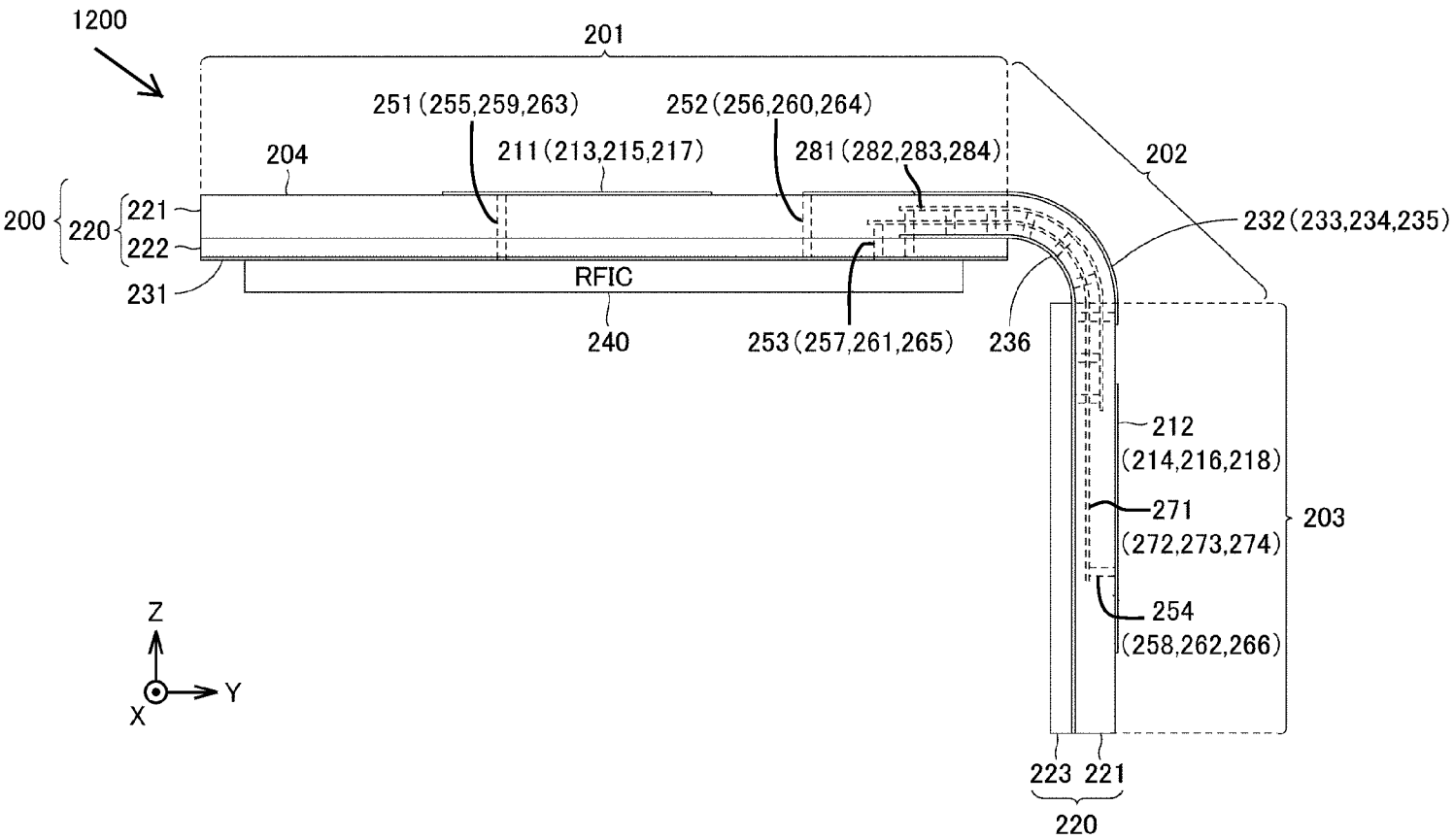
FIG. 11 is a plan view of the antenna module in FIG. 10 from an X-axis direction.

FIG. 10 is an external perspective view of an antenna module 1200 including an antenna element 200 according to embodiment 2. FIG. 11 is a plan view of the antenna module 1200 in FIG. 10 from an X-axis direction. Ground electrodes 281 to 284 and a plurality of via conductors connected to the ground electrodes 281 to 284 illustrated in FIG. 11 are not illustrated in FIG. 10 in order to make the connection relationships between the individual constituent elements easier to see.

As illustrated in FIGS. 10 and 11, the antenna module 1200 includes the antenna element 200 and an RFIC 240. The antenna element 200 includes radiation electrodes 211 to 218, a dielectric substrate 220, a ground electrode 231 (first ground electrode), ground electrodes 232 to 235 (second ground electrode), a ground electrode 236, via conductors 251 to 266, line conductor patterns 271 to 274, and the ground electrodes 281 to 284.

The dielectric substrate 220 includes a flat-plate-shaped part 201 (first part), a part 202 (second part), and a flat-plate-shaped part 203. The part 202 is thinner than the parts 201 and 203. The dielectric substrate 220 is bent in the part 202. The dielectric substrate 220 may have an additional part that is bent in addition to the part 202 and may be formed to wrap around the end of the RFIC 240.

The dielectric substrate 220 includes a dielectric layer 221 (first dielectric layer), a dielectric layer 222 (second dielectric layer), and a dielectric layer 223. The dielectric layer 221 is formed so as to span across the parts 201 to 203. The dielectric layer 221 includes a specific surface 204. The dielectric layer 221 is formed from a material having flexibility (flexible material). The dielectric layer 221 is bent in the part 202. The dielectric layer 222 is formed in the part 201. The dielectric layer 223 is formed in the part 203. The dielectric substrate 220 may be formed from a single piece of dielectric material.

The radiation electrodes 211, 213, 215, and 217 are arranged along the X axis on the specific surface 204 of the part 201. A normal direction of the radiation electrodes 211, 213, 215, and 217 is a Z-axis direction.

The ground electrode 231 is arranged on the dielectric layer 222 so as to face the radiation electrodes 211, 213, 215, and 217 in the Z-axis direction. The ground electrode 231 is capacitively coupled to the radiation electrodes 211, 213, 215, and 217 in the Z-axis direction.

The via conductors 251, 255, 259, and 263 penetrate through the ground electrode 231 and respectively connect the radiation electrodes 211, 213, 215, and 217 and the RFIC 240 to each other. The via conductors 251, 255, 259, and 263 are insulated from the ground electrode 231.

The RFIC 240 supplies a radio-frequency signal to the radiation electrodes 211, 213, 215, and 217 through the via conductors 251, 255, 259, and 263. The RFIC 240 receives radio-frequency signals from the radiation electrodes 211, 213, 215, and 217 through the via conductors 251, 255, 259, and 263.

The ground electrodes 232 to 235 are arranged along the X axis on the specific surface 204 of the part 202. The ground electrodes 232 to 235 are spaced apart from the radiation electrodes 211 to 218. The ground electrodes 232 to 235 are capacitively coupled to the radiation electrodes 211 to 218. The via conductors 252, 256, 260, and 264 respectively connect the ground electrodes 231 and the ground electrodes 232 to 235 to each other. The radiation electrodes 211, 213, 215, and 217 are capacitively coupled to the via conductors 252, 256, 260, and 264. Note that the via conductors 252, 256, 260, and 264 do not have to be formed along the thickness direction (Z-axis direction) of the dielectric substrate 220 and may instead be formed at an angle to the thickness direction.

The radiation electrodes 212, 214, 216, and 218 are arranged along the X axis on the specific surface 204 of the part 203. A normal direction of the radiation electrodes 212, 214, 216, and 218 is a Y-axis direction.

The ground electrode 236 is formed on the dielectric layer 221 so as to span the parts 201 to 203. The ground electrode 236 faces the radiation electrodes 212, 214, 216, and 218 in the Y-axis direction. The ground electrode 236 is capacitively coupled to the radiation electrodes 212, 214, 216, and 218. The ground electrode 236 is connected to the ground electrode 231. Note that, in the part 203 as well, the radiation electrodes 212, 214, 216, and 218 may be capacitively coupled to via conductors connecting the ground electrodes 232 to 235 and the ground electrode 236 to each other in addition to being respectively capacitively coupled to the ground electrodes 232 to 235, as with the radiation electrodes 211, 213, 215, and 217 in the part 201.

The ground electrodes 281 to 284 are formed so as to span the parts 201 to 203 and are arranged in the dielectric layer 221 along the X axis. The ground electrodes 281 to 284 are connected to the ground electrode 236 by a plurality of via conductors. The ground electrodes 281 to 284 are respectively connected to the ground electrodes 232 to 235.

The line conductor patterns 271 to 274 are formed in the dielectric layer 221 so as to span the parts 201 to 203. The line conductor pattern 271 is formed between the ground electrodes 236 and 281. The line conductor pattern 272 is formed between the ground electrodes 236 and 282. The line conductor pattern 273 is formed between the ground electrodes 236 and 283. The line conductor pattern 274 is formed between the ground electrodes 236 and 284.

The via conductors 253, 257, 261, and 265 penetrate through the ground electrode 231 and respectively connect the line conductor patterns 271 to 274 and the RFIC 240 to each other. The via conductors 253, 257, 261, and 265 are insulated from the ground electrode 231.

The via conductor 254 connects the line conductor pattern 271 and the radiation electrode 212 to each other. The via conductor 258 connects the line conductor pattern 272 and the radiation electrode 214 to each other. The via conductor 262 connects the line conductor pattern 273 and the radiation electrode 216 to each other. The via conductor 266 connects the line conductor pattern 274 and the radiation electrode 218 to each other.

The RFIC 240 supplies a radio-frequency signal to the radiation electrodes 212, 214, 216, and 218 through the line conductor patterns 271 to 274. The RFIC 240 receives radio-frequency signals from the radiation electrodes 212, 214, 216, and 218 through the line conductor patterns 271 to 274.

In the antenna element 200, the dielectric substrate 220 is bent in the part 202, and therefore a normal direction (Z-axis direction) of the radiation electrodes 211, 213, 215, and 217 and a normal direction (Z-axis direction) of the radiation electrodes 212, 214, 216, and 218 are different from each other. In the antenna module 1200, it is easier to transmit and receive radio-frequency signals having different polarizations in the directions of excitation compared to the case where the normal lines of the plurality of radiation electrodes are parallel to each other.

In addition, in the antenna element 200, since the dielectric layer 221 is formed of a flexible material, the stress generated in the bent part 202 can be reduced. Therefore, the flatness of the specific surface 204 can be maintained in the parts 201 and 203. The shifting of the normal directions of the radiation electrodes 211 to 218 from the desired directions can be suppressed. As a result, the degradation of the characteristics of the antenna element 200 caused by bending of the dielectric substrate 220 can be suppressed.

Modification of Embodiment 2

In embodiment 2, a case is described in which the dielectric substrate of an antenna element has one bent part. The dielectric substrate may instead have a plurality of bent parts. In a modification of embodiment 2, a case will be described in which the dielectric substrate has two bent parts.

Figure 12:
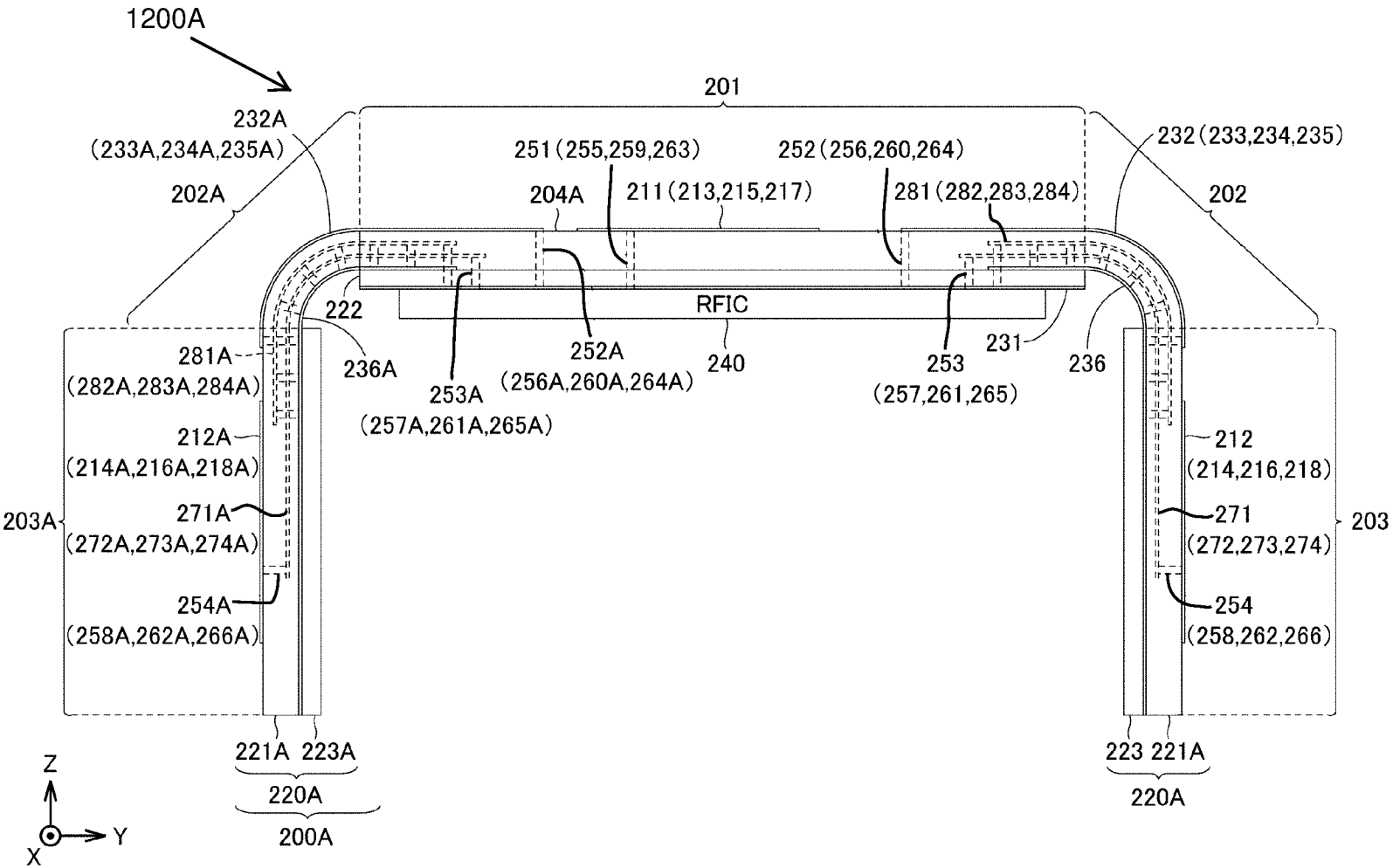
FIG. 12 is a plan view of an antenna module including an antenna element according to a modification of embodiment 2 from an X-axis direction.

FIG. 12 is a plan view of an antenna module 1200A according to the modification of embodiment 2 from an X-axis direction. The antenna module 1200A has a configuration obtained by replacing the antenna element 200 of the antenna module 1200 in FIG. 11 with an antenna element 200A. The antenna element 200A has a configuration obtained by replacing the dielectric substrate 220 with a dielectric substrate 220A, and adding radiation electrodes 212A, 214A, 216A, and 218A, ground electrodes 232A to 236A and 281A to 284A, via conductors 252A, 256A, 260A, and 264A, via conductors 253A, 257A, 261A, and 265A, via conductors 254A, 258A, 262A, and 266A, and line conductor patterns 271A to 274A. The dielectric substrate 220A has a configuration obtained by replacing the dielectric layer 221 of the dielectric substrate 220 with a dielectric layer 221A and adding parts 202A and 203A and a dielectric layer 223A to the dielectric substrate 220. The rest of the configuration is identical and therefore the description thereof will not be repeated.

As illustrated in FIG. 12, the part 203A is shaped like a flat plate. The part 202A is thinner than the parts 201 and 203A. In the dielectric substrate 220A, the part 202A connects the part 201, which extends in the Y-axis direction, and the part 203A, which extends in the Z-axis direction, to each other.

The dielectric layer 221A is formed from a material having flexibility (flexible material). The dielectric layer 221A includes a specific surface 204A. The dielectric substrate 220A is bent in the part 202A (second part) in addition to the part 202. The dielectric layer 223A is formed in the part 203A. The dielectric substrate 220A may be formed from a single piece of dielectric material.

The ground electrodes 232A to 235A are arranged along the X axis on the specific surface 204A of the part 202A. The ground electrodes 232A to 235A are spaced apart from the radiation electrodes 211, 213, 215, 217, 212A, 214A, 216A, and 218A. The ground electrodes 232A to 235A are capacitively coupled to the radiation electrodes 211, 213, 215, 217, 212A, 214A, 216A, and 218A.

The via conductors 252A, 256A, 260A, and 264A respectively connect the ground electrode 231 and the ground electrodes 232A to 235A to each other. The radiation electrodes 211, 213, 215, and 217 are capacitively coupled to the via conductors 252A, 256A, 260A, and 264A. Note that the via conductors 252A, 256A, 260A, and 264A do not have to be formed so as to extend in the thickness direction (Z-axis direction) of the dielectric substrate 220A and may instead be formed at an angle to the thickness direction.

The radiation electrodes 212A, 214A, 216A, and 218A are arranged along the X axis on the specific surface 204A of the part 203A. Normal directions of the radiation electrodes 212A, 214A, 216A, and 218A are the Y-axis direction.

The ground electrode 236A is formed on the dielectric layer 221A so as to span the parts 201, 202A, and 203A. The ground electrode 236A faces the radiation electrodes 212A, 214A, 216A, and 218A in the Y-axis direction. The ground electrode 236A is capacitively coupled to the radiation electrodes 212A, 214A, 216A, and 218A. The ground electrode 236A is connected to the ground electrode 231. Note that in the part 203A as well, the radiation electrodes 212A, 214A, 216A, and 218A may be respectively capacitively coupled to via conductors connecting the ground electrodes 232A to 235A and the ground electrode 236A to each other in addition to being respectively capacitively coupled to the ground electrodes 232A to 235A as with the radiation electrodes 211, 213, 215, and 217 in the part 201.

The ground electrodes 281A to 284A are formed so as to span the parts 201, 202A, and the 203A and are arranged in the dielectric layer 221A along the X axis. The ground electrodes 281A to 284A are connected to the ground electrode 236A by a plurality of via conductors. The ground electrodes 281A to 284A are respectively connected to the ground electrodes 232A to 235A.

The line conductor patterns 271A to 274A are formed in the dielectric layer 221A so as to span the parts 201, 202A, and 203A. The line conductor pattern 271A is formed between the ground electrode 236A and 281A. The line conductor pattern 272A is formed between the ground electrode 236A and 282A. The line conductor pattern 273A is formed between the ground electrode 236A and 283A. The line conductor pattern 274A is formed between the ground electrode 236A and 284A.

The via conductors 253A, 257A, 261A, and 265A penetrate through the ground electrode 231 and respectively connect the line conductor patterns 271A to 274A and the RFIC 240 to each other. The via conductors 253A, 257A, 261A, and 265A are insulated from the ground electrode 231.

The via conductor 254A connects the line conductor pattern 271A and the radiation electrode 212A to each other. The via conductor 258A connects the line conductor pattern 272A and the radiation electrode 214A to each other. The via conductor 262A connects the line conductor pattern 273A and the radiation electrode 216A to each other. The via conductor 266A connects the line conductor pattern 274A and the radiation electrode 218A to each other.

The RFIC 240 respectively supplies radio-frequency signals to the radiation electrodes 212A, 214A, 216A, and 218A via the line conductor patterns 271A to 274A. The RFIC 240 receives radio-frequency signals from the radiation electrodes 212A, 214A, 216A, and 218A via the line conductor patterns 271A to 274A.

In the antenna element 200A, the dielectric substrate 220A is bent in the parts 202 and 202A and therefore the normal direction (Z-axis direction) of the radiation electrodes 211, 213, 215, and 217 and the normal direction (Z-axis direction) of the radiation electrodes 212, 214, 216, 218, 212A, 214A, 216A, and 218A are different from each other. In the antenna module 1200A, it is easier to transmit and receive radio-frequency signals having different polarizations in the directions of excitation compared to the case where the normal lines of the plurality of radiation electrodes are parallel to each other.

In addition, in the antenna element 200A, since the dielectric layer 221A is formed of a flexible material, the stress generated in the bent parts 202 and 202A can be reduced. Therefore, the flatness of the specific surface 204A can be maintained in the parts 201, 203, and 203A. The shifting of the normal directions of the radiation electrodes 211 to 218, 212A, 214A, 216A, and 218A from the desired directions can be suppressed. As a result, the degradation of the characteristics of the antenna element 200A caused by bending of the dielectric substrate 220A can be suppressed.

According to the antenna elements of embodiment 2 and the modification, the radiation characteristics can be improved.

Embodiment 3

In embodiment 3, a communication device including the antenna element according embodiment 2 will be described.

Figure 13:
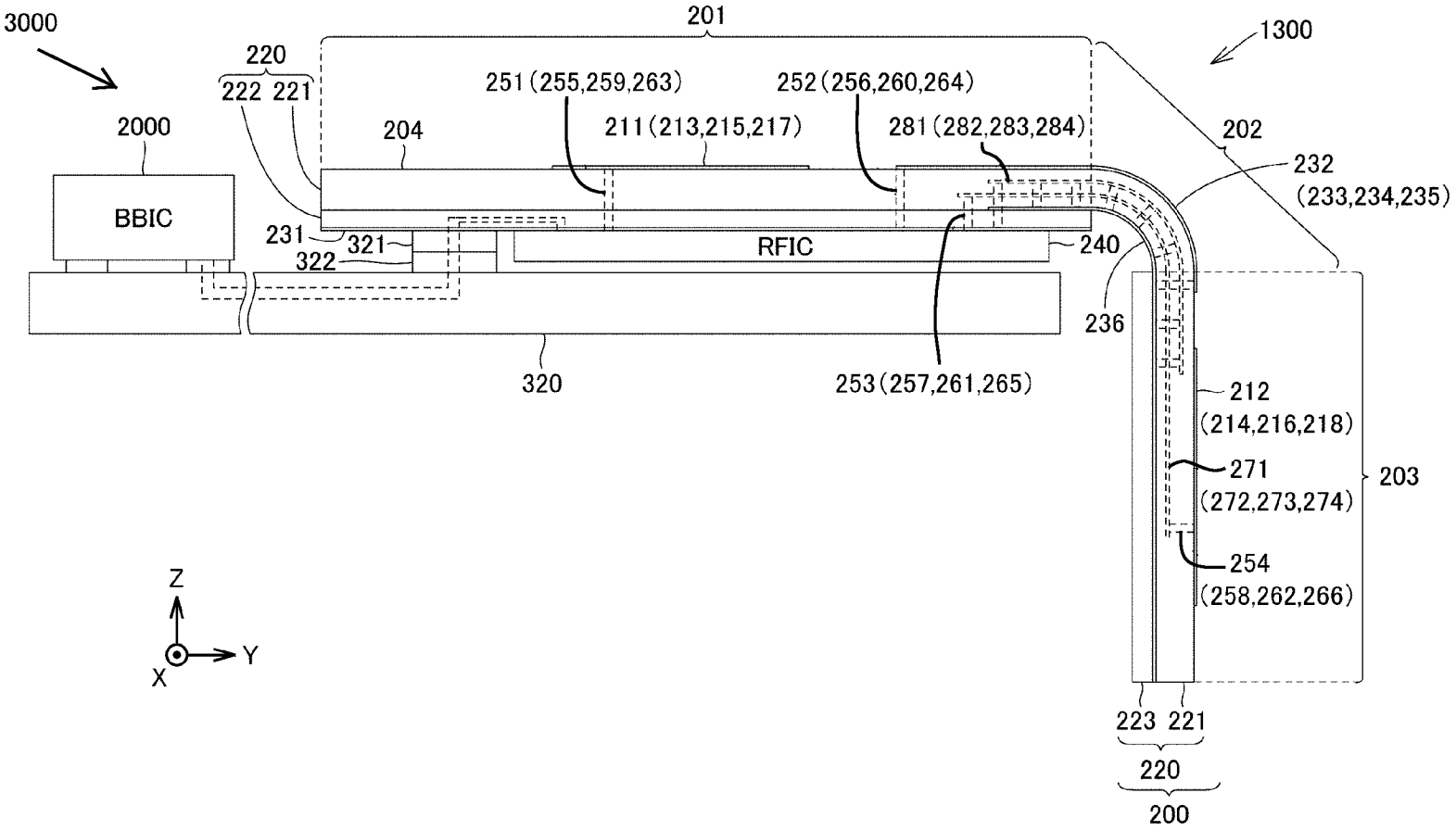
FIG. 13 is a plan view of a communication device according to embodiment 3 from an X-axis direction.

FIG. 13 is a plan view of a communication device 3000 according to embodiment 3 from an X-axis direction. As illustrated in FIG. 13, the communication device 3000 includes a BBIC 2000, an antenna module 1300, and a mounting substrate 320. The antenna module 1300 has a configuration obtained by adding a connector 321 to the antenna module 1200 illustrated in FIG. 11. The rest of the configuration is identical and therefore the description thereof will not be repeated.

As illustrated in FIG. 13, the connector 321 is arranged on the dielectric layer 222 of the part 201. The connector 321 is connected to the RFIC 240 by a feeder wiring line formed inside the dielectric layer 222. A connector 322 is arranged on the mounting substrate 320. The connector 322 is detachably connected to the connector 321.

The BBIC 2000 is arranged on a surface of the mounting substrate 320 using connection members such as solder bumps. The BBIC 2000 is connected to the connector 322 by a feeder wiring line formed inside the mounting substrate 320. The BBIC 2000 transmits a baseband signal to the RFIC 240 and receives a baseband signal from the RFIC 240 via the feeder wiring line and the connector 322. The BBIC 2000 and RFIC 240 may be connected to each other from a greater distance by routing a flexible printed circuit (FPC) therebetween.

Figure 14:
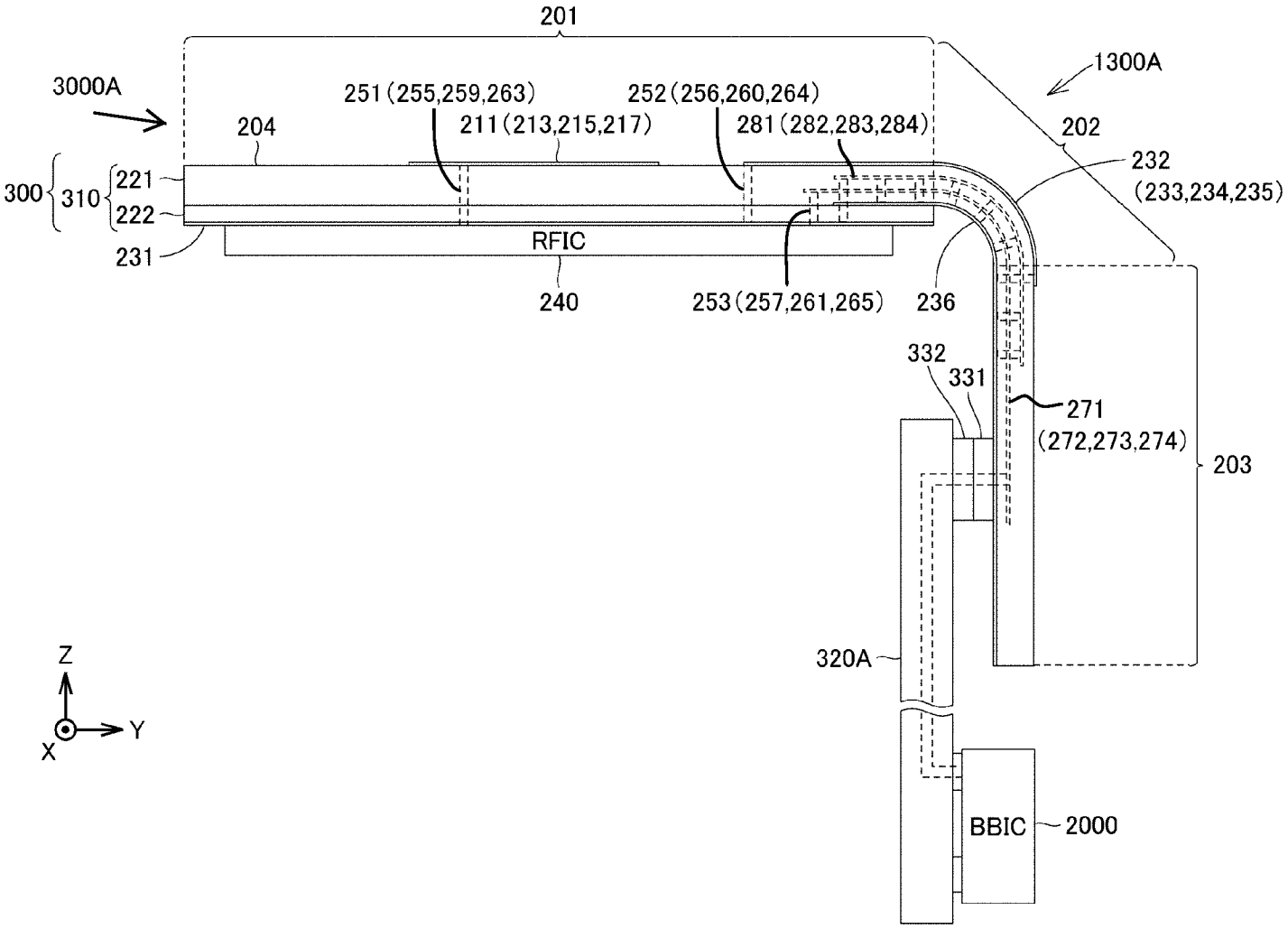
FIG. 14 is a plan view of a communication device according to a modification of embodiment 3 from an X-axis direction.

FIG. 14 is a plan view of a communication device 3000A according to a modification of embodiment 3 from an X-axis direction. As illustrated in FIG. 14, the communication device 3000A includes the BBIC 2000, an antenna module 1300A, and a mounting substrate 320A. The antenna module 1300A has a configuration obtained by replacing the antenna element 200 of the antenna module 1200 in FIG. 11 with an antenna element 300. The antenna element 300 in FIG. 14 has a configuration obtained by removing the radiation electrodes 212, 214, 216, and 218 and the via conductors 254, 258, 262, 266 from the antenna element 200 in FIG. 11, replacing the dielectric substrate 220 with a dielectric substrate 310, and adding a connector 331. The dielectric substrate 310 has a configuration obtained by removing the dielectric layer 223 from the dielectric substrate 220. The rest of the configuration is identical and therefore the description thereof will not be repeated.

As illustrated in FIG. 14, the connector 331 is arranged on the dielectric layer 221 of the part 203. The connector 331 is connected to the line conductor patterns 271 to 274. The BBIC 2000 is arranged on a surface of the mounting substrate 320A using connection members such as solder bumps. A connector 332 is arranged on the mounting substrate 320A. The connector 332 is detachably connected to the connector 331.

The BBIC 2000 is connected to the connector 332 by a feeder wiring line formed inside the mounting substrate 320A. The BBIC 2000 transmits a baseband signal to the RFIC 240 and receives a baseband signal from the RFIC 240 via the feeder wiring line, the connectors 332 and 331, the line conductor patterns 271 to 274, and the via conductors 253, 257, 261, and 265.

According to the communication devices according to embodiment 3 and the modification described above, the radiation characteristics of the antenna element can be improved.

It is assumed that the presently disclosed embodiments may be combined with each other as appropriate provided that there are no resulting inconsistencies. The presently disclosed embodiments are illustrative in all points and should not be considered as limiting. The scope of the present disclosure is not defined by the above description but rather by the scope of the claims and it is intended that equivalents to the scope of the claims and all modifications within the scope of the claims be included within the scope of the present disclosure.

10, 100, 100A to 100D, 200, 200A, 300, 900 antenna element, 31A to 31D, 33A to 33D, 37 switch, 32AR to 32DR low-noise amplifier, 32AT to 32DT power amplifier, 34A to 34D attenuator, 35A to 35D phase shifter, 36 signal multiplexer/demultiplexer, 38 mixer, 39 amplification circuit, 101, 102, 201 to 203, 202A, 203A part, 103, 204 specific surface, 110, 211 to 218, 212A, 214A, 216A, 218A radiation electrode, 120, 120A, 120B, 120D, 220, 220A, 310, 920 dielectric substrate, 121, 122, 221 to 223, 221A, 223A dielectric layer, 131, 132, 231 to 236, 232A to 236A, 281 to 284, 281A to 284A ground electrode, 140, 240 RFIC, 151, 152, 251 to 266, 252A to 254A, 256A to 258A, 260A to 262A, 264A to 266A via conductor, 271 to 274, 271A to 274A line conductor pattern, 320, 320A mounting substrate, 321, 322, 331, 332 connector, 1100, 1100A to 1100D, 1200, 1200A, 1300, 1300A, 1900 antenna module, 3000, 3000A communication device.

The invention claimed is:

1. An antenna element comprising:

a dielectric substrate including a flat-plate-shaped first part, and a second part thinner than the first part;

a radiation electrode and a first ground electrode both arranged on or in the first part so as to face each other in a thickness direction of the first part;

a second ground electrode arranged on or in the second part so as to be spaced apart from the radiation electrode and so as not to face the radiation electrode in a thickness direction of the second part; and a via conductor connecting the first ground electrode to the second ground electrode;

wherein the radiation electrode is capacitively coupled to the second ground electrode and the via conductor, a distance between the radiation electrode and the first ground electrode is equal to a distance between the second ground electrode and the first ground electrode, and the first ground electrode is arranged only on the first part.

2. The antenna element according to claim 1, wherein a distance in an extension direction of the via conductor between the radiation electrode and the first ground electrode is greater than or equal to a distance in the extension direction between the radiation electrode and the second ground electrode.

3. The antenna element according to claim 2, wherein the radiation electrode and the second ground electrode are arranged on a specific surface of the dielectric substrate.

4. An antenna module comprising:

the antenna element according to claim 2; and a radio-frequency element for supplying a radio-frequency signal to the antenna element.

5. The antenna element according to claim 1, wherein the radiation electrode and the second ground electrode are arranged on a specific surface of the dielectric substrate.

6. The antenna element according to claim 5, wherein the dielectric substrate is composed of a single piece of a dielectric material.

7. The antenna element according to claim 6, wherein the dielectric substrate is bent in the second part.

8. The antenna element according to claim 7, wherein the second part is composed of a material having flexibility.

9. An antenna module comprising:

the antenna element according to claim 8; and a radio-frequency element for supplying a radio-frequency signal to the antenna element.

10. An antenna module comprising:

the antenna element according to claim 7; and a radio-frequency element for supplying a radio-frequency signal to the antenna element.

11. An antenna module comprising:

the antenna element according to claim 6; and a radio-frequency element for supplying a radio-frequency signal to the antenna element.

12. The antenna element according to claim 5, wherein the dielectric substrate includes a first dielectric layer provided so as to span the first part and the second part and including the specific surface and a second dielectric layer provided in the first part, and the first ground electrode is arranged on or in the second dielectric layer.

13. The antenna element according to claim 12, wherein the dielectric substrate is bent in the second part.

14. An antenna module comprising:

the antenna element according to claim 12; and a radio-frequency element for supplying a radio-frequency signal to the antenna element.

15. An antenna module comprising:

the antenna element according to claim 5; and a radio-frequency element for supplying a radio-frequency signal to the antenna element.

16. The antenna element according to claim 1, wherein the radiation electrode includes a power-fed element and a non-power-fed element, the non-power-fed element is arranged between the first ground electrode and the power-fed element in the extension direction of the via conductor, and a distance in the extension direction between the power-fed element and the first ground electrode is equal to a distance in the extension direction between the second ground electrode and the first ground electrode.

17. An antenna module comprising:

the antenna element according to claim 16; and a radio-frequency element for supplying a radio-frequency signal to the antenna element.

18. The antenna element according to claim 1, wherein the radiation electrode includes a power-fed element and a non-power-fed element, the power-fed element is arranged between the first ground electrode and the non-power-fed element in an extension direction of the via conductor, and a distance in the extension direction between the second ground electrode and the first ground electrode is longer than a distance in the extension direction between the power-fed element and the first ground electrode and shorter than a distance in the extension direction between the non-power-fed element and the first ground electrode.

19. An antenna module comprising:

the antenna element according to claim 1; and a radio-frequency element for supplying a radio-frequency signal to the antenna element.

20. A communication device comprising the antenna module according to claim 19.

21. The antenna element according to claim 1, wherein the dielectric substrate includes a first dielectric layer provided so as to span the first part and the second part and a second dielectric layer provided in the first part only, and the first ground electrode is arranged only on the second dielectric layer.

* * * * *